US011440021B2

(12) United States Patent
Lutoslawski et al.

(10) Patent No.: US 11,440,021 B2
(45) Date of Patent: Sep. 13, 2022

(54) PULVERIZER SYSTEM

(71) Applicant: TORXX KINETIC PULVERIZER LIMITED, Hamilton (BM)

(72) Inventors: Jaroslaw Lutoslawski, Bradford (CA); Mark Christopher Lugowski, Scarborough (CA)

(73) Assignee: TORXX KINETIC PULVERIZER LIMITED, Hamilton (BM)

( * ) Notice: Subject to any disclaimer, the term of this patent is extended or adjusted under 35 U.S.C. 154(b) by 573 days.

(21) Appl. No.: 15/405,626

(22) Filed: Jan. 13, 2017

(65) Prior Publication Data

US 2019/0001340 A1 Jan. 3, 2019

Related U.S. Application Data

(60) Provisional application No. 62/279,309, filed on Jan. 15, 2016.

(51) Int. Cl.

| | |
|---|---|
| ***B02C 25/00*** | (2006.01) |
| ***B02C 13/18*** | (2006.01) |
| ***B02C 13/30*** | (2006.01) |
| ***B02C 13/288*** | (2006.01) |
| ***B02C 23/08*** | (2006.01) |
| *B02C 13/286* | (2006.01) |

(52) U.S. Cl.

CPC ..... *B02C 25/00* (2013.01); *B02C 13/18* (2013.01); *B02C 13/288* (2013.01); *B02C 13/30* (2013.01); *B02C 23/08* (2013.01); *B02C 2013/28636* (2013.01)

(58) Field of Classification Search

CPC ..... B02C 13/18; B02C 13/286; B02C 13/288; B02C 13/30; B02C 23/08

USPC ..... 241/30, 34

See application file for complete search history.

(56) References Cited

U.S. PATENT DOCUMENTS

| | | | |
|---|---|---|---|
| 375 | A | 9/1837 | Smith |
| 7,000 | A | 1/1850 | Goshon |
| 56,672 | A | 7/1866 | Heneage |
| 125,172 | A | 4/1872 | Chichester |
| 134,513 | A | 1/1873 | Chichester |
| 248,923 | A | 11/1881 | Dechamp |
| 277,138 | A | 5/1883 | Knight |
| 441,372 | A | 11/1890 | Morse |
| 499,795 | A | 6/1893 | Morse |
| 964,102 | A | 7/1910 | Gordon |
| 1,048,869 | A | 12/1912 | Pitcairn |
| 1,178,386 | A | 4/1916 | Edwards |

(Continued)

FOREIGN PATENT DOCUMENTS

| | | | |
|---|---|---|---|
| CN | 103934085 | A | 7/2014 |
| CN | 105833944 | A | 8/2016 |

(Continued)

*Primary Examiner* — Nhat Chieu Q Do

(74) *Attorney, Agent, or Firm* — Brooks Kushman P.C.

(57) ABSTRACT

A pulverizer may have such features as an ability to detect wrapping as well as possibly deter wrapping. A processor may also adjust the speed of rotation of the arms within the pulverizer and/or the speed of feed of input for various considerations. In fact the rotation direction may be reversed for at least brief periods of time in an effort to remove wrapped material. Vibration may also be sensed and efforts to prevent damage may be instigated by a processor.

16 Claims, 4 Drawing Sheets

(56) References Cited

U.S. PATENT DOCUMENTS 1,197,888 A 9/1916 Adams
1,212,418 A 1/1917 Sturtevant
1,212,419 A 1/1917 Sturtevant
1,300,192 A 4/1919 Overstrom
1,608,717 A 11/1926 Bell
1,636,033 A 7/1927 Agnew
1,656,756 A 1/1928 Payne
1,669,239 A 5/1928 Grindle
1,758,010 A 5/1930 Pettinos
1,798,465 A 3/1931 Grindle
1,911,193 A 5/1933 Hill
1,935,344 A 11/1933 Andrews et al.
2,012,694 A 8/1935 Runyan
2,092,307 A 9/1937 Gaffney
2,093,703 A 9/1937 Blodgett
2,125,797 A * 8/1938 Marino ..... E01H 5/104 37/227
2,130,064 A 9/1938 Bucky
2,147,666 A * 2/1939 Park ..... F02B 75/32 417/254
2,164,409 A 7/1939 Johnson
2,171,525 A 9/1939 Ainsa
2,248,927 A 7/1941 Ainsa
2,259,939 A 10/1941 Garcia
2,275,595 A 3/1942 Schwartz
2,355,784 A 8/1944 Dondlinger
2,367,906 A 1/1945 Wall et al.
2,392,958 A 1/1946 Tice
2,546,286 A 3/1951 Zakel
2,562,560 A 7/1951 Macartney
2,592,994 A 4/1952 Ahlmann
2,595,117 A 4/1952 Ahlmann
2,639,747 A 5/1953 Burn et al.
2,700,512 A 1/1955 Denovan et al.
2,707,594 A 5/1955 Moore
2,709,552 A 5/1955 Lecher
2,713,977 A 7/1955 Noll
2,750,120 A 6/1956 Pallmann
2,847,168 A 8/1958 Smiley
2,917,248 A 12/1959 Krug et al.
2,919,864 A 1/1960 Parmele
2,937,815 A 5/1960 Eirich et al.
2,940,676 A 6/1960 Brake
2,981,489 A 4/1961 Hannum, Jr.
2,992,783 A 7/1961 Wirth et al.
3,015,392 A 1/1962 Rozsa et al.
3,062,459 A 11/1962 Dearing
3,065,919 A 11/1962 Le Roy Burkett et al.
3,071,330 A 1/1963 Jackering
3,123,115 A 3/1964 Howard
3,155,326 A 11/1964 Rhodes
3,160,354 A 12/1964 Le Roy Burkett
3,180,582 A 4/1965 Danyluke
3,207,447 A 9/1965 Whitham
3,210,016 A 10/1965 Sevin et al.
3,302,895 A 2/1967 Ryder
3,326,476 A 6/1967 De Los Santos Izquierdo
3,329,350 A 7/1967 Wisgerhof et al.
3,346,203 A 10/1967 Danyluke
3,426,673 A 2/1969 Miner et al.
3,474,974 A 10/1969 Wood
3,490,704 A 1/1970 Bourne et al.
3,555,996 A 1/1971 Schwarz et al.
3,615,008 A 10/1971 Alpha
3,834,631 A 9/1974 King
3,873,034 A 3/1975 Iwahori et al.
3,887,141 A 6/1975 Francis
3,946,953 A 3/1976 Hato
3,976,002 A 8/1976 Gerlach
3,987,970 A * 10/1976 Burkett ..... B02C 13/18 241/43
4,030,670 A 6/1977 Abernathy
4,098,466 A 7/1978 Macelvain et al.
4,144,167 A 3/1979 Burkett et al.
4,151,794 A 5/1979 Burkett
4,151,959 A 5/1979 Deister
4,202,078 A 5/1980 Malinak
4,493,459 A 1/1985 Burkett
4,529,134 A * 7/1985 Williams ..... B02C 18/142 241/236
4,531,461 A 7/1985 Sayler et al.
4,593,861 A 6/1986 Blakley et al.
4,637,561 A 1/1987 Edberg
4,690,338 A 9/1987 Sayler et al.
4,886,216 A 12/1989 Goble
4,988,045 A * 1/1991 Griesedieck, III ..... B02C 18/0084 241/285.2
4,989,796 A 2/1991 Eide
5,067,661 A 11/1991 Eide
5,184,781 A 2/1993 Andela
5,192,029 A 3/1993 Harris
5,205,500 A 4/1993 Eide
5,285,973 A 2/1994 Goforth et al.
5,379,951 A 1/1995 Hughes
5,680,994 A 10/1997 Eide et al.
5,685,500 A 11/1997 Eide et al.
5,839,671 A 11/1998 Sand et al.
5,881,959 A * 3/1999 Hadjinian ..... B02C 18/145 241/186.35
6,024,307 A 2/2000 Sand et al.
6,135,370 A 10/2000 Arnold
6,179,231 B1 1/2001 Csendes
6,227,473 B1 5/2001 Arnold
6,325,306 B1 * 12/2001 Gacanich ..... B02C 13/18 241/15
6,726,133 B2 4/2004 Hahn et al.
7,222,805 B1 * 5/2007 Williams, Jr. ..... B02C 13/284 241/32
7,950,601 B2 5/2011 Watts
8,020,791 B2 9/2011 Knueven et al.
8,267,337 B2 9/2012 Webb
8,678,306 B2 3/2014 Watts
8,931,721 B2 1/2015 Jensen et al.
9,205,431 B2 12/2015 Anderson
9,498,780 B2 11/2016 Watts et al.
9,707,564 B2 7/2017 Mogan et al.
9,751,087 B2 9/2017 Watts et al.
2002/0117564 A1 * 8/2002 Hahn ..... B02C 13/18 241/1
2016/0045919 A1 * 2/2016 McDaniel ..... B02C 13/18 241/191

FOREIGN PATENT DOCUMENTS

EP 0202424 B1 8/1990
EP 0525362 B1 10/1994
WO 1989008752 A1 9/1989
WO 1993002797 A1 2/1993
WO 1998055234 A1 12/1998
WO 2008131477 A1 11/2008

* cited by examiner

PULVERIZER SYSTEM

CLAIM OF PRIORITY

The present application claims the benefit of U.S. Provisional Patent Application No. 62/279,309 filed Jan. 15, 2016, which is incorporated herein by reference in its entirety.

FIELD OF THE INVENTION

The present invention relates to a pulverizer also known as a vertical grinding mill which are provided with a rotating shaft with a plurality of arms spinning thereabout which generate a series of air currents inside of a cylinder to pulverize, separate, aerate, and/or homogenize material.

BACKGROUND OF THE INVENTION

Solid materials such as garbage, rubbish or other solid materials have been collected by trucks and transported for disposal for many years.

Burkett developed a centrifugal mill sometime around in the mid-1970s and ended up with U.S. Pat. No. 3,987,970 and others. The applicant's predecessor-in-interest filed Canadian Patent Application Nos. 2,125,797 and 2,147,666 for use with various equipment and methods for pulverizing rock and remediating soil utilizing an improved pulverizer configuration. All three of these patents/applications are incorporated herein by reference in their entirety.

Still others have commercialized an embodiment of the Burkett mill and are trying to sell that design in the marketplace today. However, when attempting to build a Burkett mill with improvements, the applicant discovered there were components of that basic design which could be improved.

SUMMARY OF THE INVENTION

It is the present object of many embodiments of the present invention to provide an improved vertical gyroscopic mill or pulverizer having advanced capabilities.

It is another object of many embodiments of the present invention to provide an improved pulverizer having improved safety features.

It is another object of many embodiments of the present invention to provide an improved pulverizer having improved performance characteristics.

It is another object of many embodiments of the present invention to provide improved efficiency, possibly coupled to increased output and/or reduced down time.

It is another object of many embodiments to provide improved performance for a pulverizer by having adjustable air flow characteristics other than adjustable shaft rotation speed alone.

It is another object of many embodiments of the present invention to provide an improved shaft wrapping removal system.

It is another object of many embodiments of the present invention to provide an improved dust collection system.

Accordingly, in accordance with a presently preferred embodiment of the present invention, a pulverizer or vertical gyroscopic mill can be combined with a conveyor system for (a) feeding the pulverizer and/or (b) likely for removing discharge. The speed of the conveyor(s), particularly the feed conveyor, as well as the speed of the rotation of the pulverizer are preferably controlled by a processor possibly in an interrelated manner. Furthermore, the shaft may be driven by a variable frequency drive motor or other variable speed motor to allow for the processor to control aspects of the speed of the motor. Feedback loops are helpful for some operations of the processor as well, such as to maintain constant power levels and/or feed flows.

A system may control the rate of infeed to at least assist in controlling the process for at least some embodiments.

A system may control the speed of the rotor for some embodiments such as to maintain a specified power level and/or for other objectives.

Additionally, for at least some embodiments, it may be that the speed of the motor and the speed of the conveyor can be linked together so that if the speed of the shaft rotation of the pulverizer is sensed to decrease, then the speed of the conveyor can be correspondingly decreased as well, such as a proportional amount, possibly as compared to overall speeds, amount of decrease or other amounts. Furthermore, if a high resistant object is encountered with an arm and the shaft speed slows down a significant amount, it may be that the processor can direct the ramping back up of the shaft speed after a sudden slow down possibly as well as a corresponding slowing down and then speeding up of the conveyor.

For some embodiments, a vibration sensor can be used to detect when the shaft and/or other components of the pulverizer are vibrating too much to then direct a potential shut down sub-routine to determine the cause of the vibration. The vibration could be caused by unbalanced loading, which could be addressed by first slowing, and then possibly stopping the feed conveyor. The shaft may be slowed slightly, or significantly to see if the vibration clears. Finally, if none of the above slows the vibration issue, the shaft may be stopped.

Additionally, software of at least some embodiments can detect wrapping by sensing an increase in amperage possibly coupled with other effects such as no significant increase or decrease in output or throughput and/or other effects. Once detecting a wrapping step, the processor may stop the shaft. After stopping the feed conveyor, the processor may direct a reverse direction of the shaft for a predetermined speed and/or time (or alternating directions) to allow attempt to dislodge material from wrapped arms. Similarly, if resistance is deemed too low, the processor can speed up certain factors.

Additionally, in an effort to prevent shaft wrapping which can often occur with the top of the pulverizer above the uppermost arm segments, at least one cutting mechanism can be provided in an effort to attempt to cut material which may otherwise wrap towards an upper end of the shaft.

A door opening prevention separator lock for many embodiments can be provided to prevent an access door of the pulverizer from being opened while in operation, or even during spin down after shutting off the pulverizer. Once the shaft is stopped, the interlock may then allow the access door to open.

Additionally, software can be used to maintain the environment of pressure below ambient such as at some vacuum value possibly in combination with a dust depression system at an outlet of the pulverizer possibly with a separator lock option at the outlet so as to prevent, or at least significantly reduce dust in the environment to reduce dust about the pulverizer during operation.

Still these and/or other features may be provided with still other embodiments.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENTS

Figure 1:
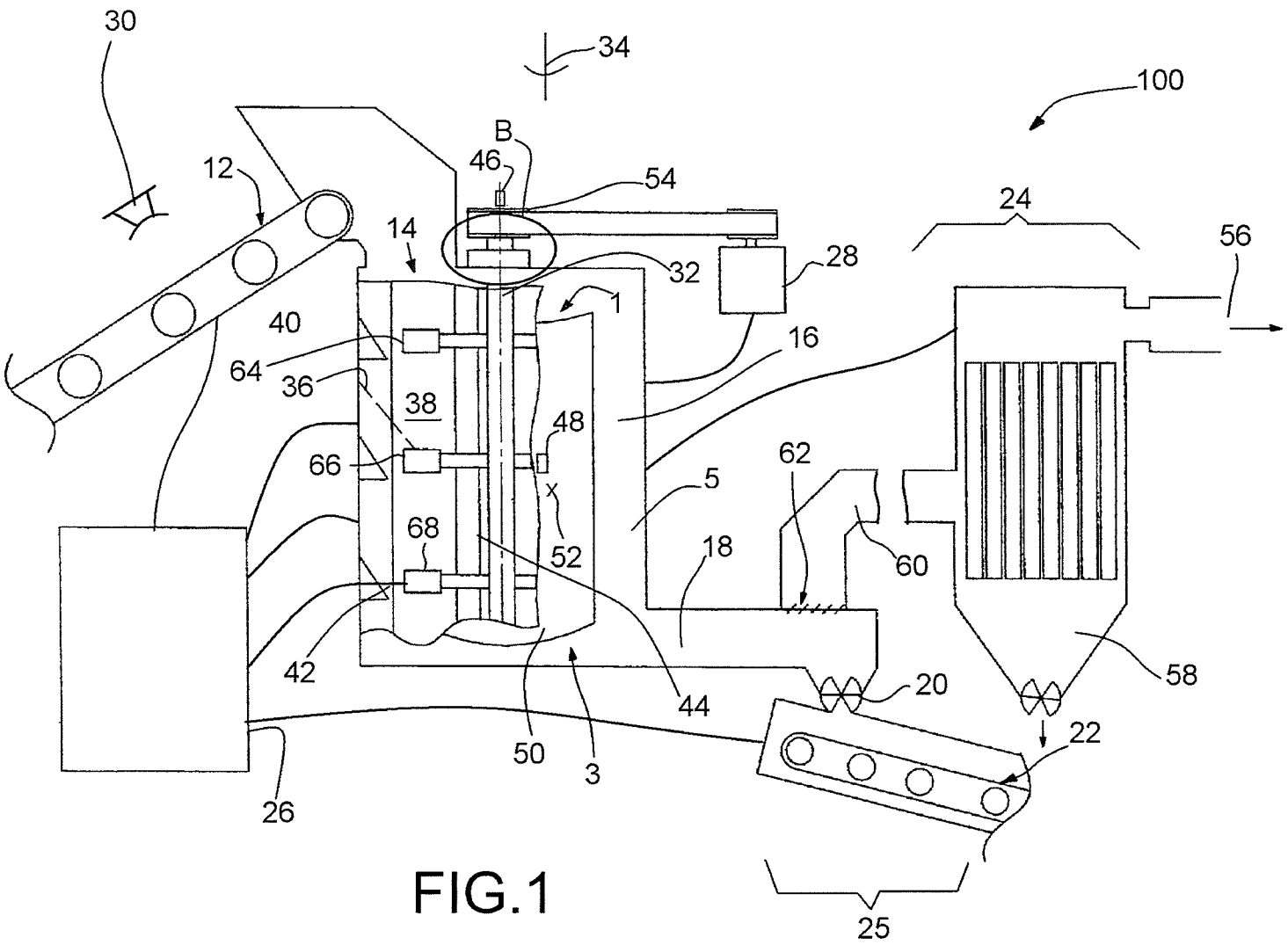
FIG. 1 is a schematic representation of a pulverizer system of a presently preferred embodiment of the present invention.
Figure 2:
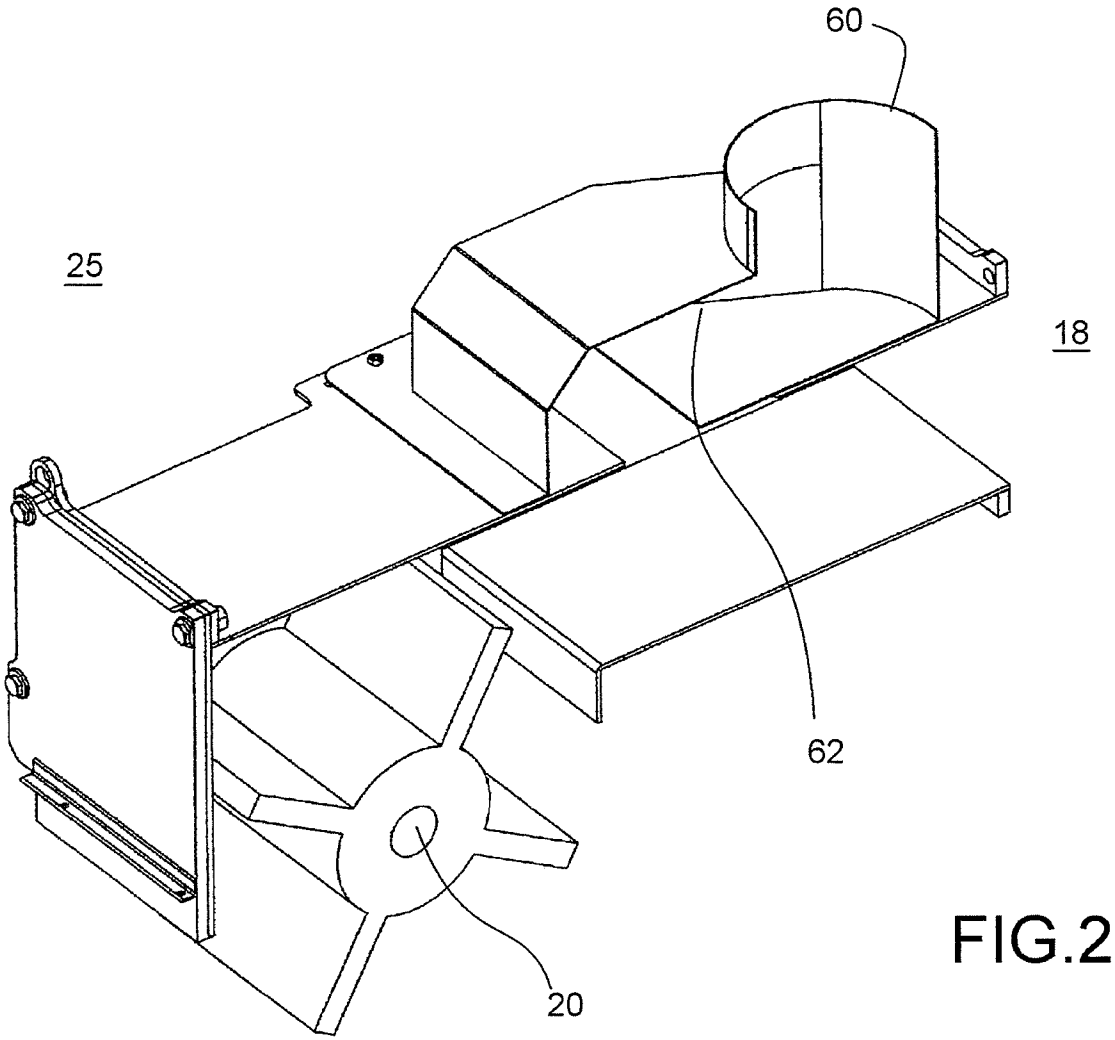
FIG. 2 is a detailed cross sectional view of the dust collection intake shown in FIG. 1.
Figure 3:
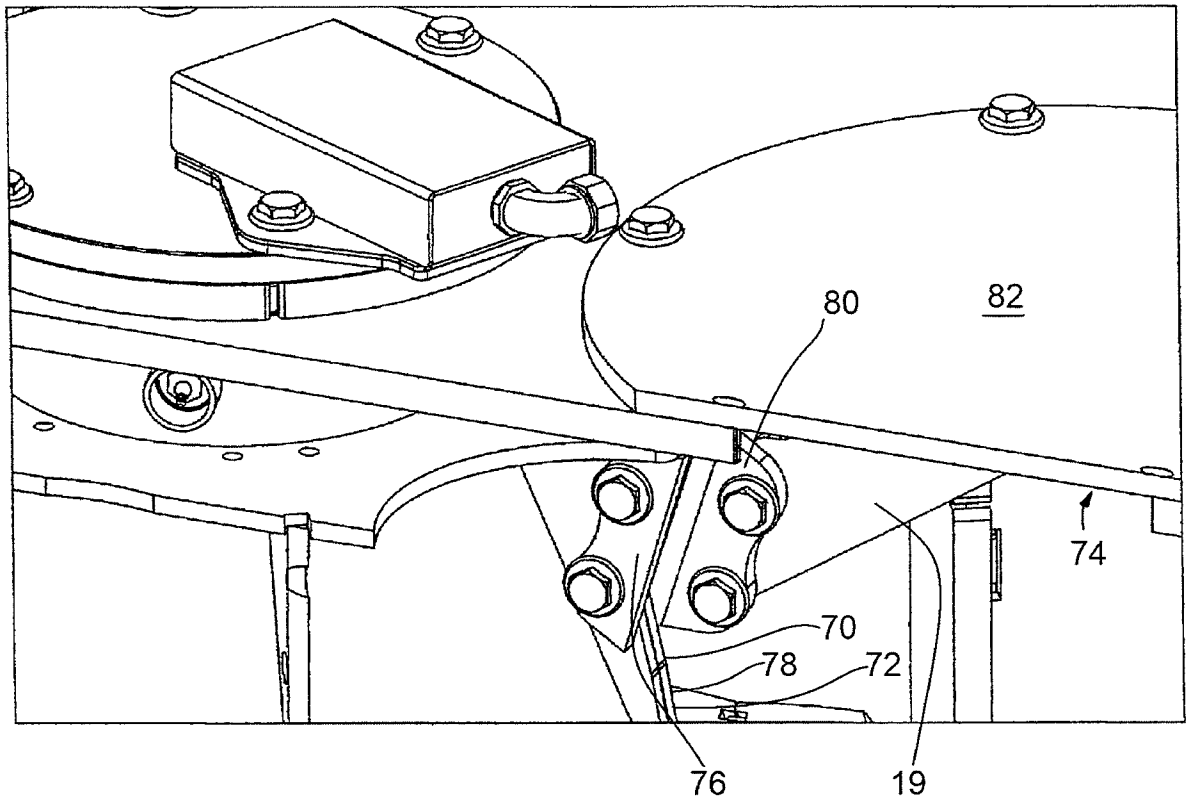
FIG. 3 is an internal view of detail B shown in FIG. 1.

FIG. 1 shows essentially a schematic representation of the pulverizer system 100 in the form of a feed conveyor 12, feeding to an inlet 14 of a pulverizer 16. Once material is pulverized, it exits out at 18 where optional air lock 20 may assist in discharging ground material onto conveyor 22 or alternatively, it may be that material directed from outlet is deposited directly onto conveyor 22 without optional air lock 20, illustrated.

Figure 4:
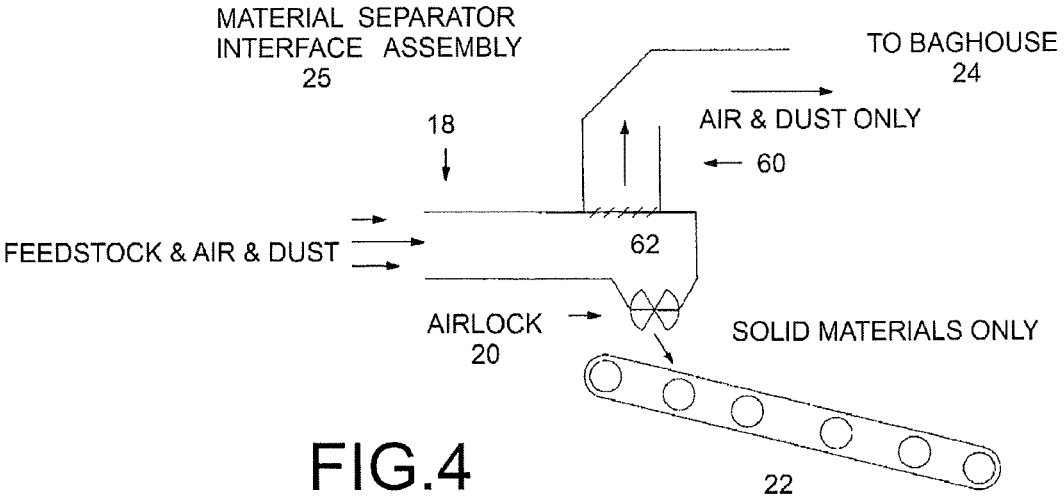
FIG. 4 is a schematic view of a portion of the present invention.

Dust collector system 24 is useful for some, if not many embodiments, to remove dust and will be described in further detail with reference back to FIGS. 1 and 4, possibly under the direction of processor 26. Processor 26 can control many aspects of the system 100 in the pulverizer 16 as will be discussed in further detail below.

The pulverizer 16 is preferably equipped with a variable speed motor 28 such as a variable frequency drive motor which can allow for the processor 26 to assist in controlling the speed of the motor 28. Additionally, the processor 26 may also control the speed of feed of the conveyor 12.

For instance, by having a processor 26 control operation of both the feed (i.e., the amount of fed material) into inlet 14 by controlling the speed of the conveyor 12, possibly in combination with sensors such as sensor 30 directed at conveyor 12 which can sense the input of material into inlet 14. The amount of feed directed into the pulverizer 16 through inlet 14 can be monitored and/or controlled possibly in combination with the speed of rotation of the shaft 32 in an effort to address a variety of different operating conditions.

For instance, during normal operations, if a particular hard grind product is directed into inlet 14, the shaft 32 may reduce rotational speed about rotation axis 34. In order to ramp back up to optimal, it may be that the processor 26 has a ramp up speed routine as provided to the motor 28 so that instead of attempting to instantaneously maintain speed, either a predetermined ramp up routine is selected such as a linear increase or non-linear curve back to speed or possibly having a predetermined intermediate speeds back up to an optimum speed is achieved by the processor 26 running software as provided therewith. Conveyor 12 may follow a similar or dissimilar routine.

Another aspect of the pulverizing system 100 is that the input as provided through inlet 14 can be varied, possibly together with the speed of rotation of the shaft 32 by the motor 28 under certain operating conditions as well. Depending on the particular type of input in inlet 14, a different rate of feed of the conveyor 12 can be selected relative to the speed of the rotation of the shaft 32 about axis 34. Other factors may be addressed with processor 26 to attempt to improve efficiency as well.

Depending on the particular input at issue, it may be that the speed of rotation of the shaft 32 can be selected relative to the speed of the conveyor 12 and/or vice versa and/or the amount of input in inlet 14 possibly in combination with the sensor 30 or other way to measure input into inlet 14. Another feature which can be controlled with the pulverizer 16 is its internal pressure which may be assisted in being controlled by a dust collection system 24 or other system. By directing the pressure inside pulverizer 16 to possibly be below atmospheric pressure such as by using the dust control system 24, the relative size of particulate leaving the outlet 18 can be reduced. Under certain circumstances, the particulate size as deposited from the outlet conveyor 22 may be more preferably controlled by addressing a pressure in the pulverizer 16, such as with processor 26. Of course, outlet conveyor 22 could have material redirected back into inlet 14 under certain conditions to regrind material and/or could be controlled by processor 26 as well. Dust collection system 24 could be useful to prevent the area around the pulverizer 16 from being a dusty mess. Dust collecting system 24 may also collect useful products from the grinding operation.

Also, when the shaft 32 is ramping back up to speed as directed by the processor but the processor 26 may also simultaneously slow down the conveyor 12 and/or maintain a predetermined speed during the ramp up process so as to not overload the input in the inlet 14 of the pulverizer 16.

Also, the processor 26 may perform other functions like direct the flow of input into inlet 14 in order to attempt to maintain a relatively stable power level based on consumption of energy of either the overall system and/or by the motor 28.

For instance, when encountering an increased power consumption by the motor 28, it may be that the input is slowed such as by slowing the conveyor 12 or other step. Furthermore if power consumption is not significant enough as consumed the motor 28, it may be that the conveyor 12 can be sped up by the processor 26.

In addition to providing instructions to control both the speed of the motor 28, to thus control the rotational speed of the shaft 32, as well as the speed of the conveyor 12, it may be that there is a feed back loop provided back to the processor 26 for various effects. For instance, it has been discovered that through shelf height optimization, as will be described in further detail below, it may be that a higher throughput (i.e., a higher rate of flow from both into the inlet 14 and outlet 18) can be achieved with a lower power consumption of the motor 28 based on the shelf 36 being provided at a selected height provided through way of adjustment. A 20% higher throughput has been achieved for some feed streams by selecting the specific height of the shelf 36 for some embodiments. By changing the shelf 36 height, the vortices flow in at least the middle section 38 can be varied to effectively change the configuration of those vortices, at least elevationally. Furthermore, it may be that the change in shelf height 36 it may be imparted to the other shelves namely 40 and/or 42 and/or other shelves which could be changed in height as well. Additionally, the relative shape of deflectors or shelves 36, 40, 42 such as deflector 44 in a similar or dissimilar manner as the shelf 36 is changed in height as will be explained in further detail below.

By providing a feedback route such as with an accelerometer 46 connected to the shaft 32 as well as a variable speed motor 28 such as could be driven by a variable frequency drive system or otherwise, a way of not only providing a desired signal to the motor 28 for a desired speed of the shaft 32 can be provided, but also the speed itself can be sensed with sensor 46 and provided to processor 26.

Other sensors can be utilized with this system which are not presently utilized. Specifically, a door locking interlock and/or sensor 48 can be provided for use by processor 26 or other device so that access door 50 so that the door 50 may not be opened as illustrated in FIG. 1, unless the shaft 32 is stationary. This feature can prevent the door 50 from being unlocked such as with locking system 52 as might be restrained from opening by lock 48 under certain conditions. Additionally, a vibration sensor 54 may be provided so as to be able to sense vibration of the shaft 32 and/or other portions of the pulverizer 16. A vibration protocol may be employed by the processor 26 so that upon reaching a first predetermined amount of vibration, certain steps are performed such as by first slowing down the motor 28 and/or conveyor 12 to see if the vibration diminishes, and if not, then possibly securing the conveyor 12 and then end the motor 28. A second predetermined amount could result in shutdown of the motor 28 directly.

If the vibration sensor 54 detects the shaft 32 as sensing too much vibration, then it could indicate that a pin is sheared, an arm pad has been damaged, or other complicating factor internal to the pulverizer 16 which could then be somewhat of a self-diagnosing pulverizer 16. If a second predetermined amount of vibration is sensed, it may be that the motor 28 is secured immediately as opposed to going through a slowing step to discourage internal damage in the pulverizer 16.

Of course, the processor 26 could also control the air lock 20, if utilized, as well as the speed of being able to move material onto conveyor 22 and/or the speed of the conveyor 22. Processor 26 may also control the air flow through the dust controller system 24 if utilized and/or could assist in maintaining a desired pressure such as a vacuum or other pressure internal to the pulverizer 16 and/or assist in maximizing efficiency of the fan 56 of the dust collector 24 for efficiency or other purposes such as removing dust of a given particulate size.

Fan 56 might be a 30 horsepower motor capable of drawing 1000 cubic feet per minute or have other specifications for various other dust collector systems 24. It turns out that for many processes, the dust collected in various bags 58 can prove to be quite valuable such as when grounding electronics, it may be that gold dust can be retrieved from the bags 56, 58. Other waste may have other valuable components which may be recovered from waste bags 58. Plenum 60 could be made of the appropriate gauge of material to be able to withstand the suction forces as provided by fan 56 and it may be that the amount of suction can be varied such as not only with the speed of the fan 56 but also with the size of the opening 62 as will be discussed in further detail with reference to FIG. 4 below either of which could be controlled by processor 26 or otherwise.

The software used by the processor 26 could detect wrapping such as by sensing an increase of amperage without noticing any increase in output 18 and/or input 14 and/or possibly also observing that the amperage is slowly increasing by the motor 28 as it being required by the motor 28. Vibration sensed by the vibration sensor 54 may also contribute to the ability to detect wrapping.

If wrapping is occurring on the arms, such as any of arms 64, 66, 68, then a routine can be employed to attempt to shed the wrap material from the arms. Specifically, the shaft 32 could be stopped as shown by processor and possibly even the arms 64-68 could then be reversed in direction to attempt to free the arms 64-68 from the wrap material. It may be that a series of spinning in the first direction about the axis and then reversing direction about the axis 34 may be employed in order to attempt to remove such material. Should this step fail to work, then it may be that the door 50 might need to be opened or the shafts 32 stopped to remove any excess wrapped material.

Figure 5:
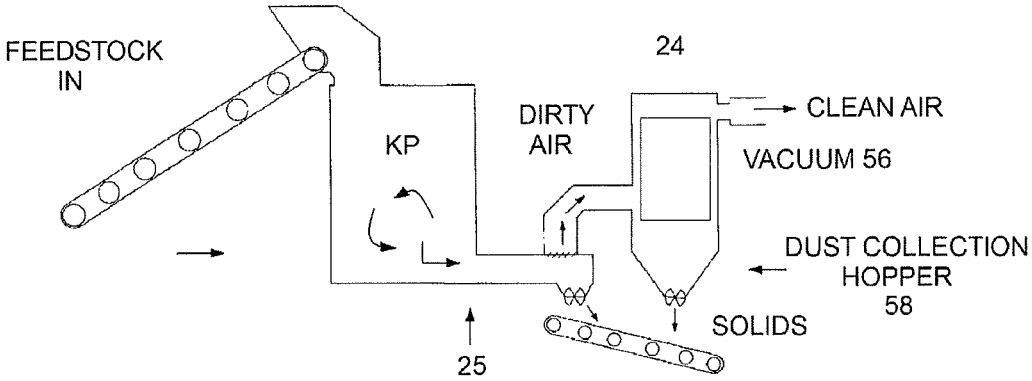
FIG. 5 is a schematic view of a portion of the present invention.

Additionally, if wrapping up on the shaft 32 such as at any of the hubs or even towards the upper portion 74 of pulverizer 16, a shaft wrapping removal system could be employed similar to the one shown in FIG. 5. Specifically, a spacing rib 70 is shown which can assist in pushing material up and away from the shaft 32 or alternatively along a shedding cone 72 or such as one outwardly extending from shaft 32 which might otherwise direct material up towards the spacing rib 70 and/or upper portion 74 of the pulverizer 16. As it travels up the spacing rib 70, it may encounter a first blade 76 which preferably cuts through any material as it passes through or certainly once a predetermined thickness illustrated as thickness 78 is encountered, a second blade or stop 80 can contact the material to either assist in pushing that wrapped material against the first blade 76 and/or cut wrap material with the second blade or stop 80. Accordingly, the most that could be possibly wrapped would likely be of a thickness 78 between the first blade 76 and the second blade or stop 80. Accordingly, as the material attempts to wrap, the material is removed and cut by the blades 76 and/or 80. VHS tapes particularly have a tendency to come unraveled and perform as well as do other certain feed stocks possibly including wires, labels, plastic and/or other materials.

The cone 72 when utilized works as a shedding cone to assist the direction of such materials up into the cutting area of the shaft wrapping removal device illustrated. An access plate 82 may be useful to be able to open the access either the first or second cutting blade 76, 80 possibly from outside the pulverizer 16 for adjustment and/or replacement. The cone 72 can be a shedding cone and can further assist in the ability to direct material up to the cutting surfaces of the blade 76 and/or 80. The cone 72 has a larger diameter at a bottom of the cone 72 and increases in diameter before going downwardly.

Accordingly, some embodiments provide a pulverizer 16 comprising a top 1 with an inlet 14, and a conveyor 12 feeding an inlet 14 at the top, a bottom 3, a drum 5 located between the top 1 to the bottom 3, a rotating shaft 32 having radially extending arms 64, 66, 68 creating flow currents within the pulverizer thereby reducing the size of product input at the inlet 14 and discharged at the bottom 3 at exit 18, and a processor 26 directing the speed of at least one, if not both, of (a) the shaft 32 and (b) the conveyor 12 based at least partially on input of sensors 30 and/or 46, and/or others. A variable speed motor 28, such as a variable frequency drive motor or other motor, directed by the processor 26 may drive the shaft. The processor 26 may be used for other functions such as at least assist in controlling pressure in the drum of the pressurizer 16 such as by controlling a dust collection system 24, possibly having a variable vacuum controlled by the processor 26. Another processor function may be directing the rotation of the shaft 32 in one of a forward and a reverse direction based on detected wrapping of debris about one of the shaft and the arms 64, 66, 68.

Some embodiments may provide a shaft speed sensor 46 and further comprising a feed back loop communicating shaft speed to the processor 26. These or other embodiments may provide a door interlock 48 whereby the processor 26 prevents opening an access door 50 to the drum when the shaft 32 is rotating. These or other embodiments may provide a vibration sensor such as 46 with the processor 26 directing slowing down the pulverizer 16 if vibration exceeds a first predetermined threshold, and/or stopping the pulverizer 16 if vibration exceeds a second predetermined threshold.

Some embodiments may provide a wrap detection algorithm used by the processor 26 whereby wrapping of material about the arms 64, 66, 68 is detected by performance of the pulverizer 16. Some algorithms may employ sensing at least one of an increase in amperage required by the motor 28, slowing down of the shaft and increased vibration such as may be sensed by sensor 46 and/or another sensor. If wrapping about the shaft 32 is detected, some embodiments may provide, the pulverizer 16 reverses direction of rotation of the shaft 32, at least briefly in an effort to dislodge wrapped material on the arms 64-68. Spacing ribs 70 and/or a shedding cone 72 located in the drum 5 toward the inlet 16 at the top 1, or upper portion 74 of the pulverizer 16, may be useful to discourage wrapping for many embodiments as well. With the shedding cone 72, for at least some embodiments, at least one blade 76 or 80 near a top of the cone 72 may assist in cutting debris which might otherwise wrap about the shaft 32. Still other embodiments may have some, or all of these features, as well as, or even others.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A pulverizer comprising:

a top, and a conveyor feeding an inlet at the top;

a bottom;

a drum located between the top and the bottom;

a rotating shaft extending vertically within the drum between the top and bottom, the rotating shaft having radially extending arms creating flow currents within the pulverizer thereby reducing the size of product input at the inlet so as to produce a size reduced material that is discharged at an outlet;

a motor coupled to the rotating shaft;

a vibration sensor coupled to the rotating shaft to sense vibration of the rotating shaft, and a processor communicating with at least one sensor programmed for:

directing the rotation speed of the shaft based at least partially on input of the at least one sensor; and directing the speed of the conveyor based on at least one of an amperage of the motor and the rotation speed of the shaft;

monitoring the amperage of the motor;

monitoring a throughput rate of flow of the inlet or the outlet;

determining that material is wrapped around at least one of the arms or the shaft based on detection of an increase in the amperage of the motor while sensing no increase in the throughput rate of flow does not increase;

upon determining that material is wrapped around the at least one of the arms or the shaft, slowing and stopping the rotation of the shaft and subsequently temporarily reversing rotation of the shaft;

temporarily reducing the speed of the conveyor upon detection, by the at least one sensor, of one of the slowing and the stopping of the shaft; and reducing the speed of at least one of the motor and the conveyor if vibration sensed by the vibration sensor exceeds a first predetermined threshold.

2. The pulverizer of claim 1 wherein the motor comprises a variable speed motor driving the shaft which receives direction from the processor.

3. The pulverizer of claim 1 wherein the motor has a variable frequency drive.

4. The pulverizer of claim 1 wherein the processor at least assists in controlling a pressure within the drum.

5. The pulverizer of claim 4 further comprising a vacuum applied to the drum.

6. The pulverizer of claim 5 further comprising a dust collection system having a variable vacuum controlled by the processor.

7. The pulverizer of claim 1 wherein the at least one sensor comprises a shaft speed sensor for a feed back loop for communicating shaft speed to the processor.

8. The pulverizer of claim 1 further comprising a door interlock whereby the processor is configured to prevents opening an access door to the drum when the shaft is rotating.

9. The pulverizer of claim 1 wherein the processor directs stopping the shaft if the vibration of the rotation shaft exceeds a second predetermined threshold.

10. The pulverizer of claim 1 wherein the processor has a wrap detection algorithm whereby wrapping of material about the arms is detected by performance of the pulverizer.

11. The pulverizer of claim 10 whereby the wrap detection algorithm further comprises sensing at least one of an increase in amperage required by the motor, slowing down of the shaft and increased the vibration of the shaft.

12. The pulverizer of claim 10 whereupon sensing wrapping, the pulverizer reverses direction of rotation, at least briefly in an effort to dislodge wrapped material on the aims.

13. The pulverizer of claim 1 further comprising spacing ribs located proximate to the arms to assist in preventing wrapping.

14. The pulverizer of claim 1, wherein the processor is further configured for increasing the speed of the shaft in a forward direction when the wrapping of material around at least one of the arms and the shaft is no longer detected and for reducing or maintaining the speed of the conveyor during the increasing of the speed of the shaft.

15. A pulverizer comprising:

a top, and a conveyor feeding an inlet at the top;

a bottom;

a drum located between the top and the bottom;

a rotating shaft extending vertically within the drum between the top and bottom, the rotating shaft having radially extending arms creating flow currents within the pulverizer thereby reducing the size of product input at the inlet so as to produce a size reduced material that is discharged at an outlet;

a vibration sensor coupled to the rotating shaft to sense vibration of the rotating shaft;

a motor coupled to the rotating shaft; and a processor communicating with at least one sensor and configured for:

monitoring an amperage of the motor;

monitoring a throughput rate of flow of the inlet;

if the amperage of the motor increases when the throughput rate of flow does not increase, determining that material is wrapped around at least one of the arms or the shaft;

upon determining that material is wrapped around the at least one of the arms or the shaft, slowing, stopping and subsequently temporarily reversing rotation of the shaft; and temporarily reducing the speed of the conveyor upon detection, by the at least one sensor, of one of the slowing and the stopping of the shaft; and reducing the speed of at least one of the motor and the conveyor if vibration sensed by the vibration sensor exceeds a first predetermined threshold.

16. The pulverizer of claim 15 wherein the processor directs the speed of at least one of (a) the shaft and (b) the conveyor based at least partially on input of the vibration sensor and the at least one sensor.

* * * * *